US006667570B2

(12) United States Patent
Kim et al.

(10) Patent No.: US 6,667,570 B2
(45) Date of Patent: Dec. 23, 2003

(54) STRUCTURE OF PANEL IN FLAT-TYPE CRT

(75) Inventors: Byoung-Chul Kim, Seoul (KR); Do-Hoon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/949,716

(22) Filed: Sep. 12, 2001

(65) Prior Publication Data

US 2002/0027408 A1 Mar. 7, 2002

(30) Foreign Application Priority Data

Sep. 1, 2000 (KR) ..... 10-2000-51664

(51) Int. Cl.[7] ..... H01J 29/10

(52) U.S. Cl. ..... 313/477 R; 313/461; 220/2.1 A; 220/2.3 A

(58) Field of Search ..... 313/477 R, 364, 313/461; 220/2.1 A, 2.3 A

*Primary Examiner*—Ashok Patel

(74) *Attorney, Agent, or Firm*—Birch, Stewart, Kolasch & Birch, LLP

(57) ABSTRACT

Disclosed is a structure of panel in flat-type CRT (Cathode Ray Tube), which is capable of securing a stable vacuum intensity by applying sufficient tension to a face part of a panel using a straight safety band, and of effectively reducing an advance of a crack and scattering of fragments due to an external shock, by optimizing the relationship among an MMH (Mold Match Height), a CFT (Center Face Thickness) and an OAH (Overall Height), which are design factors. The structure of panel in flat-type CRT (Cathode Ray Tube) includes a face part having a flat outer surface and an inner surface of a fixed curvature, and a skirt part extending from an edge of the face part to a rear portion. When a height from a MML (Mold Match Line), which is an extension line of a match line between an upper external mold and a lower external mold to form the panel, to an outer center of a face of the panel is designated as a MMH and a thickness of the center of the face surface of the panel is designated as a CFT, the relationship between the MMH and the CFT satisfies MMH≦CFT.

5 Claims, 5 Drawing Sheets

STRUCTURE OF PANEL IN FLAT-TYPE CRT

BACKGROUND OF THE INVENTION

1. Field of the Invention

The present invention relates to a structure of panel in flat-type CRT (Cathode Ray Tube), and more particularly, to a structure of panel in flat-type CRT, which is capable of improving implosion-proof properties of a flat-type CRT by effectively reducing the advance of cracks caused by an external shock and scattering of fragments resulting from the shock.

2. Description of the Related Art

In general, as shown in FIG. 1, a flat-type CRT (Cathode Ray Tube) includes: a panel 1; a shadow mask 3 fixed on a rear surface of the panel 1 such that a tension is applied to the shadow mask 3 and having a plurality of apertures of round or slot type for selecting colors of an electron beam 6; a magnetic shield 7 fixed on the inside of the panel 1 to prevent the path of electron beam 6 from being changed by an earth magnetic field or a leakage magnetic field; a funnel 2 fixed on the panel 1 by a frit glass and having a neck part formed integrally at a rear portion; an electric gun (not shown) inserted and sealed in the neck part of the funnel 2 for emitting the electron beam 6 of three colors, i.e., R, G and B colors; and a deflection yoke 5 mounted to wrap the external circumference of the neck part for deflecting the electron beam 6.

Meanwhile, because the inside of the flat-type CRT may be easily damaged due to an external shock (being in a high vacuum condition), the panel 1 is designed to withstand atmospheric pressure.

Moreover, the panel 1 is divided into a face part 1*a* and a skirt part 1*b*. The skirt part 1*b* has a safety band 8 mounted to disperse stress applied to the flat-type CRT due to the high vacuum condition and to secure the shock resistance capacity.

When the flat-type CRT is operated, the electron beam 6 of the electric gun mounted in the neck part of the funnel 2 strikes a luminescence surface 4 formed on an inner surface of the panel by anode voltage applied to the flat-type CRT. The electron beam 6 is deflected in all directions by the deflection yoke 5 before reaching the luminescence surface 4, and then it reaches the luminescence surface 4.

At this time, the neck part has magnets 9 of bipolarity, tetrapolarity and hexapolarity at a rear portion for correcting an advance orbit in order for the electron beam 6 to strike a prescribed fluorescence body, thereby preventing staining that affects color purity.

Referring to FIG. 2*a*, a structure of the panel of the flat-type CRT will be described hereinafter in more detail.

In general, the panel of the flat-type CRT has an outer surface (in the form of a plane) and a curved inner surface having a prescribed curvature. As shown in FIG. 2*a*, the panel 1 is the thinnest in a center face thickness (hereinafter, called as a CFT) and becomes gradually thicker toward the outer circumference.

The outer circumference of the panel 1 has a discontinuous part generated during a molding process of the panel. The discontinuous part is a mold match line (hereinafter, called as a MML) and is the same form which a belt is bound around the outer circumference of a panel thereof.

At this time, a size of a mold match height (hereinafter, called as a MMH), which is a height from the MML to a front surface of the panel 1, is larger than that of the CFT of the panel 1.

Particularly, an opposite angle portion thickness (OAPT) of the panel 1 is designed to be thick 160% or more, compared with the CFT.

A height from an end of the skirt part 1*b* of the panel 1 to a front surface of the face part 1*a* is designated as an overall height (hereinafter, called as an OAH).

A manufacturing process of the panel of the conventional flat-type CRT will be described as follows.

In general, as shown in FIG. 2*a*, the outer circumference of the panel 1 has prescribed angles θ1 and θ2 formed toward the face part 1*a* and the skirt part 1*b* respectively centering around the MML. Thus, in consideration of a slip of the mold, if only one external mold is used, the molding cannot be performed.

Therefore, as shown in FIG. 2*b*, one internal mold 10 and two external molds 11*a* and 11*b* are combined and used.

Here, the external molds are divided into an upper external mold 11*a* and a lower external mold 11*b*.

Therefore, when the panel 1 is molded, the upper and lower external molds 11*a* and 11*b* are matched to form an external form of the panel 1. After a glass material of a prescribed amount is inserted into the external molds 11*a* and 11*b*, the internal mold 10 (to form the inner surface of the panel 1) is lowered to a position where a prescribed interval between the internal mold 10 and the external molds 11*a* and 11*b* is maintained. The internal mold 10 is raised up after a predetermined period of time is passed.

At this time, the panel 1 must be formed to have a thickness sufficient to endure a predetermined vacuum pressure after the CRT is finished. The interval between the external molds 11*a* and 11*b* and the internal mold 10 must be set to have different intervals according to the standard of the panel 1.

That is, the CFT of the panel 1 is determined by the interval between the center of the external molds 11*a* and 11*b* and the center of the internal mold 10.

Because the cathode ray tube manufactured by the above method is made of the glass material and the inside of the cathode ray tube is in a vacuum condition, there is a danger of accidents and scattering of the fragments if cracks or implosion occurs due to an external shock. The safety band 8 made of a metal material is attached to the skirt part 1*b* of the panel 1 to prevent such danger.

The reason that the safety band 8 is attached to the skirt part 1*b* of the panel 1 is that the greatest tension stress caused by the vacuum is at the skirt part 1*b* and the scattering of the glass fragments is generated in the skirt part 1*b* as well.

Therefore, the safety band 8 is contacted to the skirt part 1*b* of the panel 1 apply sufficient tension to the safety band 8.

At this time, the tension of the safety band 8 must be adequate not only for the skirt part 1*b* but also for the face part 1*a* of the panel 1.

Conventionally, the safety band 8, which is bent to correspond with the outer angles of panel 1 of lower portion of MML θ1 and with the outer angles of panel 1 of upper portion of MML θ2, is used to transfer the sufficient tension to the face part 1*a* of the panel 1.

However, there is a problem in that the tension of the safety band 8 is not applied sufficiently to the face part 1*a* in spite of the bent structure of the safety band 8.

That is, as shown in the drawing, based on the MML, because a circumference of the skirt part 1*b* located at the lower portion of the MML is larger than that of the face part 1*a* located at the upper portion of the MML, when the safety band 8 wound in a heat expansion state is contracted while cooled, stronger tension is applied to the skirt part 1*b*, which has the outer circumference larger than that of the face part 1*a*, compared to the face part 1*a*.

In the conventional panel 1, as described above, because the tension is not sufficiently applied to the face part 1*a* of the panel 1, the crack generated by shock easily advances to the inside of the panel 1 as shown in FIG. 4, and thereby the crack may be generated throughout the face part 1*a* of the panel 1.

That is, in the structure of the conventional panel 1, the MML located at the lower portion of the CFT does not effectively prevent the advance of a crack toward the inside of the panel, and thereby there is a limitation in that the panel 1 has stable implosion-proof properties.

Furthermore, to use the safety band 8 of the bent structure, equipment for bending a straight band must be prepared, and thus additional expenses for preparing the equipment are required. Moreover, a recovery rate of the product is lowered in comparison with the straight band 8, and thus manufacturing costs are increased.

The reason that the safety band 8 of the bent structure is used in spite of the above disadvantages is to solve a problem of the straight safety band in that the safety band is contacted to only the skirt part 1*b* located at the lower portion of the MML of the panel 1 and thereby the tension is concentrated on the skirt part 1*b*.

That is, in a case of using the straight safety band on the panel 1, because the angle θ2 formed toward the face part 1*a* located at the upper portion based on the MML is still larger than the angle θ1 formed toward the skirt part 1*b* located at the lower portion based on the MML, the tension of the safety band is concentrated on the skirt part 1*b*, and thereby the crack of the face part 1*a* advancing by the external shock is not reduced effectively and the scattering of the fragments due to shock is not effectively prevented.

Meanwhile, it is advantageous to reduce the MMH to apply stronger tension to the face part 1*a* of the panel 1 and to secure the stable proof-implosion-proof properties.

However, if the OAH is left as is and only the MMH is reduced, the length of the skirt part 1*b* is increased. Thus, in case forming the panel using the mold, when the upper external mold 11*a* is separated, scratches or other deformation may occur in the skirt part 1*b*.

Furthermore, in case that the OAH is left as is and only the MMH is reduced, if the upper external mold 11*a* is separated in a state in which the glass material is not sufficiently cooled, the skirt part 1*b*, which is not hardened completely after the molding, may be transformed due to its own weight. Moreover, even though the transformation due to the weight of the skirt part 1*b* does not occur, the skirt part 1*b* may be transformed by being shaken by external influences, e.g., vibration of a conveyer, when the skirt part 1*b* is transferred to the next step.

Meanwhile, the CRT, which has the inside of a vacuum condition, must effectively recover from a depression of the panel 1 due to the vacuum condition by the reinforcement of the safety band. However, if the length of the skirt part 1*b* of the panel 1 is short, the safety band cannot secure a sufficient width, and thereby the CRT cannot recover the panel 1 to its original condition.

Moreover, if the length of the skirt part 1*b* of the panel 1 is short, the tension stress against glass products is applied to a conjunction part between the panel 1 and the funnel 1. To solve the above problem, the OAH must be long.

On the contrary, if the length of the skirt part 1*b* of the panel 1 is too long, the skirt part 1*b* of the panel 1 becomes too thin to secure available picture area in the inside of the panel 1. In this case, a relatively high stress is applied to a connection part between the face part 1*a* and the skirt part 1*b*.

In brief, in the conventional panel structure, since the MMH is larger than the CFT, sufficient tension is not applied to the face part 1*a*, and thus it is difficult to obtain a stable vacuum intensity and to effectively reduce the advance of a crack. Furthermore, additional equipment expenses for bending the safety band are required.

Therefore, to solve the above problems and to secure the stable vacuum intensity and the implosion-proof properties of the panel 1, a demand of the optimization of the relationship among the MMH, the CFT and the OAH is on the rise.

SUMMARY OF THE INVENTION

It is, therefore, an object of the present invention to provide a panel in flat-type CRT (Cathode Ray Tube), which is capable of securing a stable vacuum intensity by applying sufficient tension to a face part of a panel even though a straight safety band is used.

It is another object of the present invention to provide a panel in flat-type CRT, which is capable of effectively reducing an advance of a crack and a scattering of fragments due to external shock.

It is a further object of the present invention to provide a panel in flat-type CRT, which optimizes the relationship among an MMH (Mold Match Height), a CFT (Center Face Thickness) and an OAH (Overall Height), which are design factors, to make distribution of the stress of an outer surface of the CRT even and to prevent the concentration of tension stress.

To achieve the above objects, the present invention provides a structure of panel in flat-type CRT (Cathode Ray Tube), which includes a face part having a flat outer surface and an inner surface of a fixed curvature, and a skirt part extending from an edge of the face part to a rear portion, wherein, when a height from a MML (Mold Match Line) to an outer center of a face of the panel is designated as a MMH and a thickness of the center of the face surface of the panel is designated as a CFT, the relationship between the MMH and the CFT satisfies $MMH \leqq CFT$, the MML being an extension line of a match line between an upper external mold and a lower external mold to form the panel.

When a height from an end of the skirt part of the panel to a front surface of the face part is designated as an OAH, the relationship between the OAH and the CFT satisfies $0.12 \leqq CFT/OAH \leqq 0.15$.

BRIEF DESCRIPTION OF THE DRAWINGS

Further objects and advantages of the invention can be more fully understood from the following detailed description taken in conjunction with the accompanying drawings in which:

FIGS. 6*a* and 6*b* are graphs showing analysis results of implosion-proof properties according to the change of a MMH (Mold Match Height) of the panel according to the present invention, wherein FIG. 6*a* is a graph of the relationship between the MMH and a length of the crack; and FIG. 6*b* is a graph of the relationship between the MMH and a distance of fragment scatter.

DETAILED DESCRIPTION OF PREFERRED EMBODIMENTS

Figure 1:
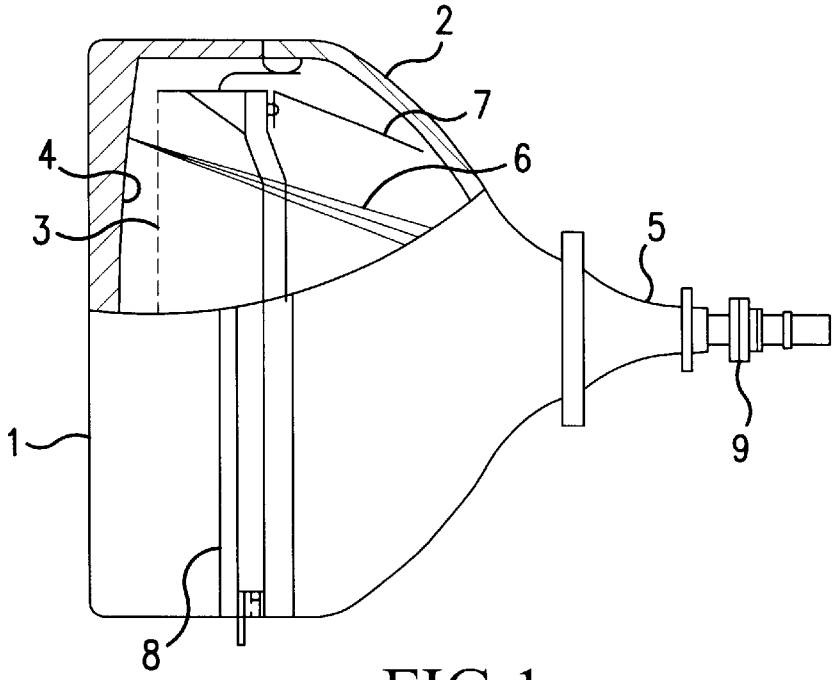
FIG.1 BACKGROUND ART
FIG. 1 is a side sectional view, partly in section, of a structure of a conventional flat-type CRT (Cathode Ray Tube)
Figure 2A:
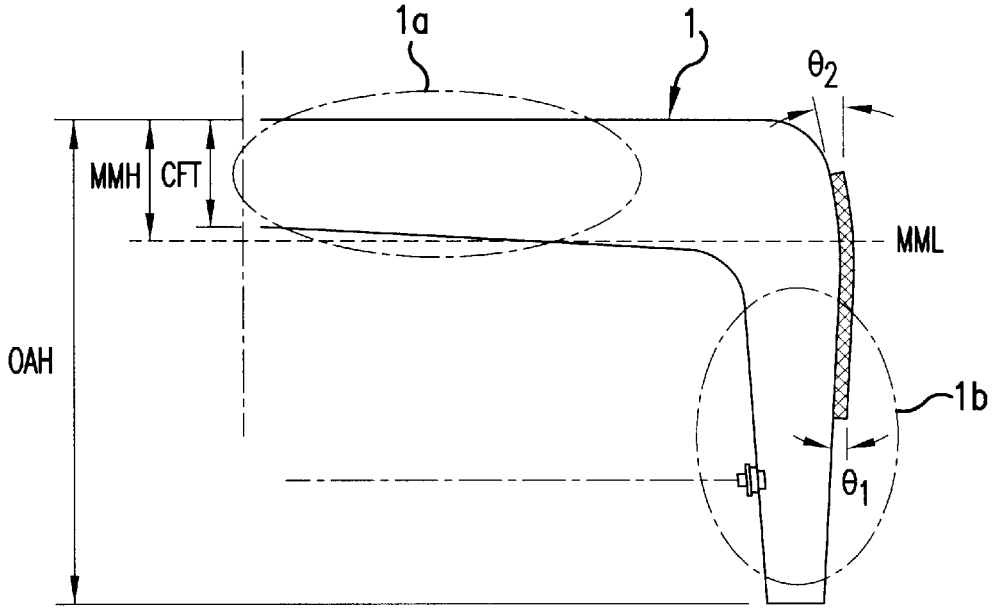
FIG.2a BACKGROUND ART
FIG. 2*a* is a cross sectional view for explaining the structure of FIG 1.
Figure 2B:
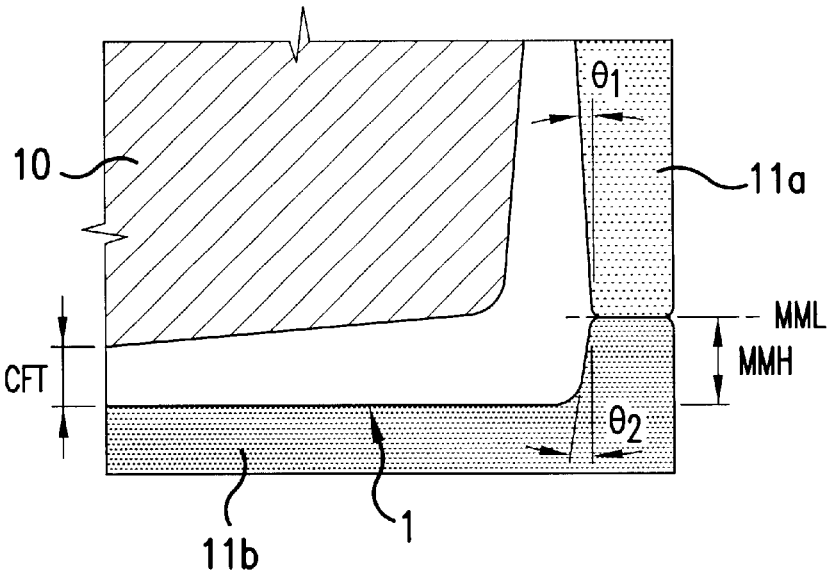
FIG.2b BACKGROUND ART
FIG. 2*b* is a schematic view of a structure of a mold for forming the panel of FIG. 1.

The present invention will now be described in detail in connection with preferred embodiments with reference to the accompanying drawings. For reference, like reference characters designate corresponding parts throughout several views.

Referring to FIGS. 3 through 7, a preferred embodiment of the present invention will be described in detail as follows.

A conventional panel for a CRT (Cathode Ray Tube) having a curvature in inner and outer surfaces is advantageous in a vacuum intensity, but a panel 1 for flat-type CRT having a flat outer surface and an inner surface, which becomes gradually even, to flatten visually is disadvantageous in the vacuum intensity and to secure a stable vacuum intensity.

That is, the implosion-proof properties of the flat-type CRT improve by optimizing the relationship among an MMH (Mold Match Height), a CFT (Center Face Thickness) and an OAH (Overall Height), which are design factors.

Therefore, it is required to optimize the relationship between design factors of the panel 1 to secure a stable vacuum intensity of the panel 1 for the flat-type CRT and to improve implosion-proof properties.

For this, in this invention, the relationship among an MMH (Mold Match Height), a CFT (Center Face Thickness) and an OAH (Overall Height) in the panel for the flat-type CRT is optimized by analyzing the relationship between the CFT and the vacuum intensity, the relationship between the MMH and a length of a crack, the relationship between the MMH and a scatter distance of fragments, and the relationship between the CFT/OAH and stress. Referring to FIGS. 3 through 7, an application of the present invention to a panel of the flat-type CRT having a size greater than 29 inches will be described in detail hereinafter.

First, referring to FIGS. 3 and 5, the relationship between the CFT and the vacuum intensity in the panel according to the present invention will be described.

Figure 3:
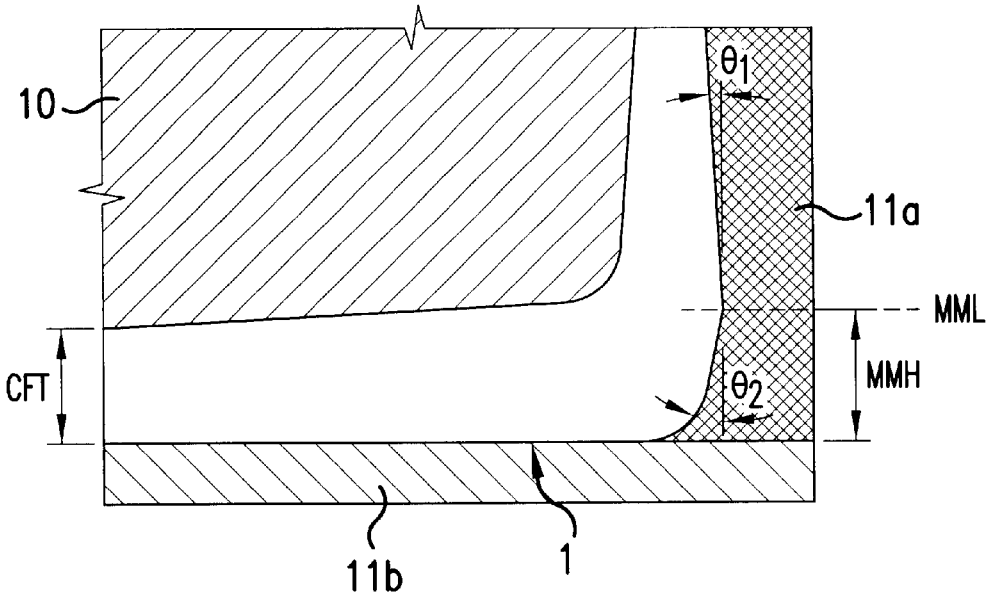
FIG. 3 is a cross sectional view of a structure of a panel according to the present invention.
Figure 4:
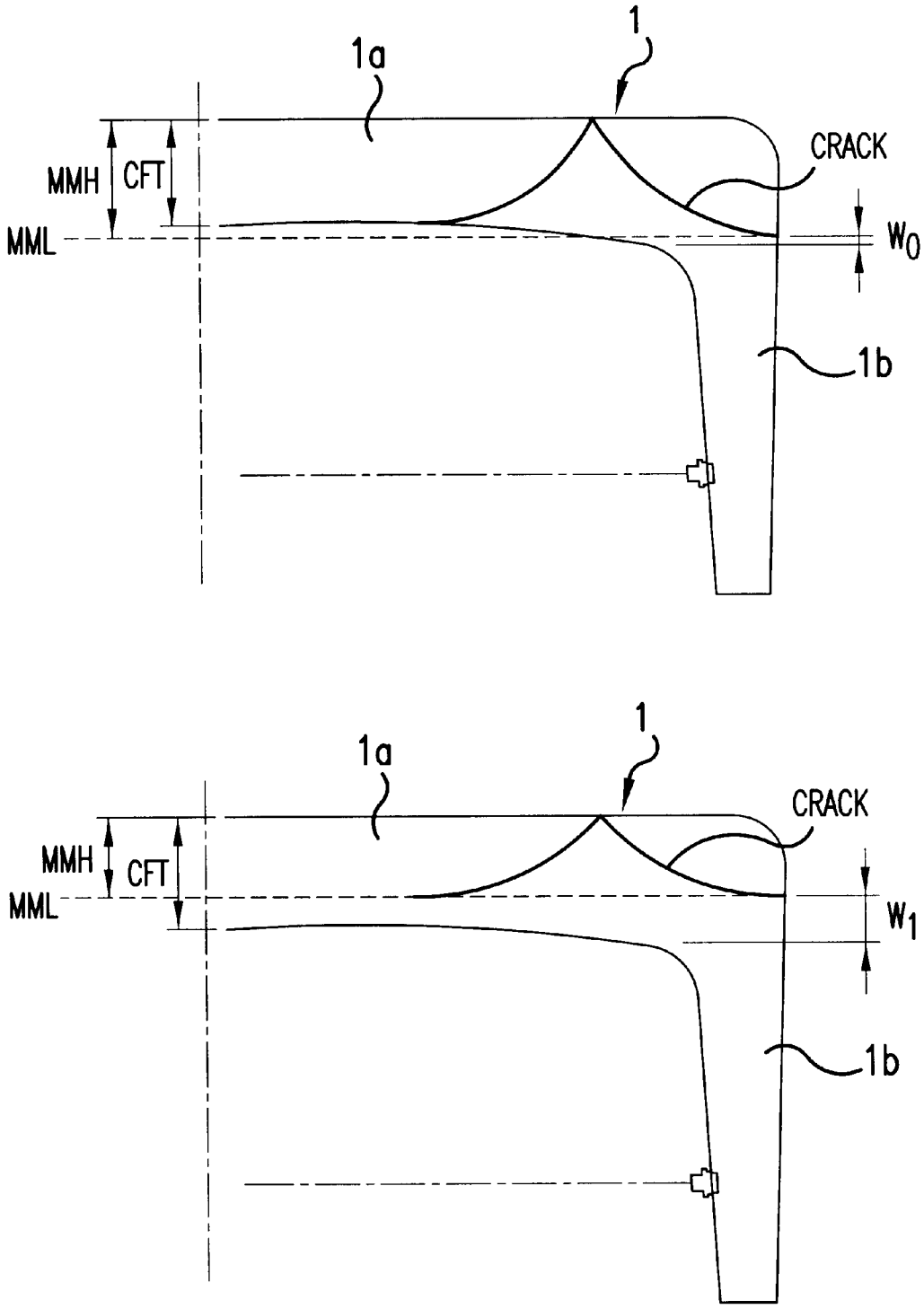
FIG. 4 is a cross sectional view showing a difference in an advance of crack between the conventional panel and the present invention.
Figure 5:
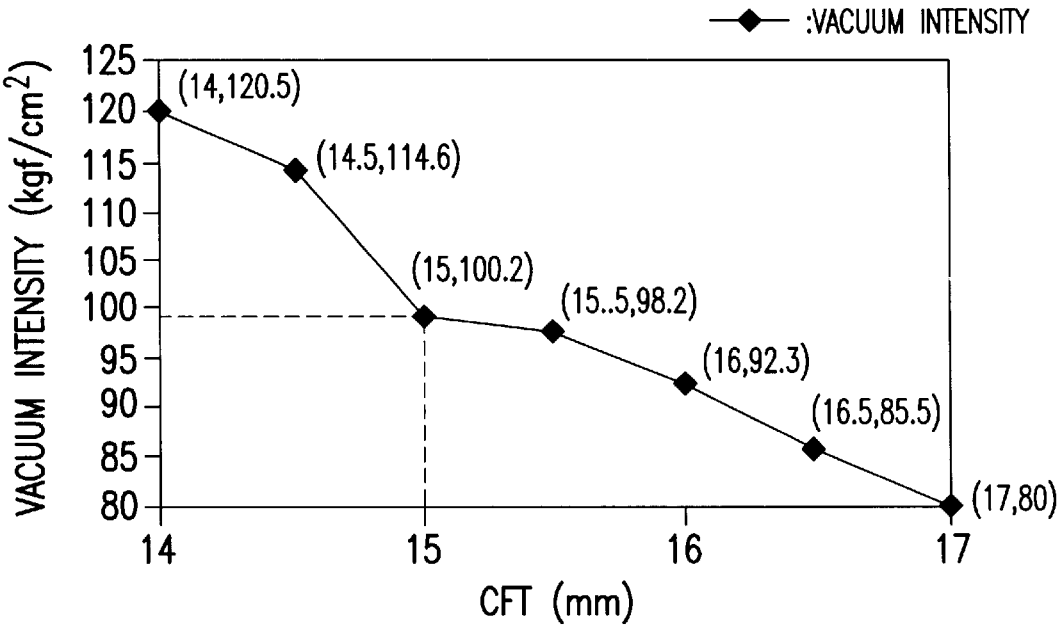
FIG. 5 is a graph showing an analysis result of vacuum intensity according to the change of a CFT (Center Face Thickness) of the panel according to the present invention.

FIG. 3 is a cross sectional view of a structure of a panel according to the present invention and FIG. 5 is a graph of an analysis result of the vacuum intensity according to a change of the CFT of the panel 1 according to the present invention. In the case of the panel 1 applied to the flat-type CRT having a size greater than the 29 inch standard, as shown in FIGS. 3 and 5, if the relationship between the MMH and the CFT satisfies MMH≦CFT and the CFT is more than 15 mm so that the stress applied to the CRT is lower than 100 kgf, stable vacuum intensity can be secured, wherein the MMH designates a height from a MML (Mold Match Line), which is an extension line of a match line between an upper external mold 11*b* and a lower external mold 11*b* to form the panel 1, to an outer center of a face of the panel 1, and CFT designates a thickness of the center of the face surface of the panel 1.

Next, referring to FIGS. 6*a* and 6*b*, the relationship between the change of the MMH to the CFT of the panel and the implosion-proof properties will be described.

Figure 6A:
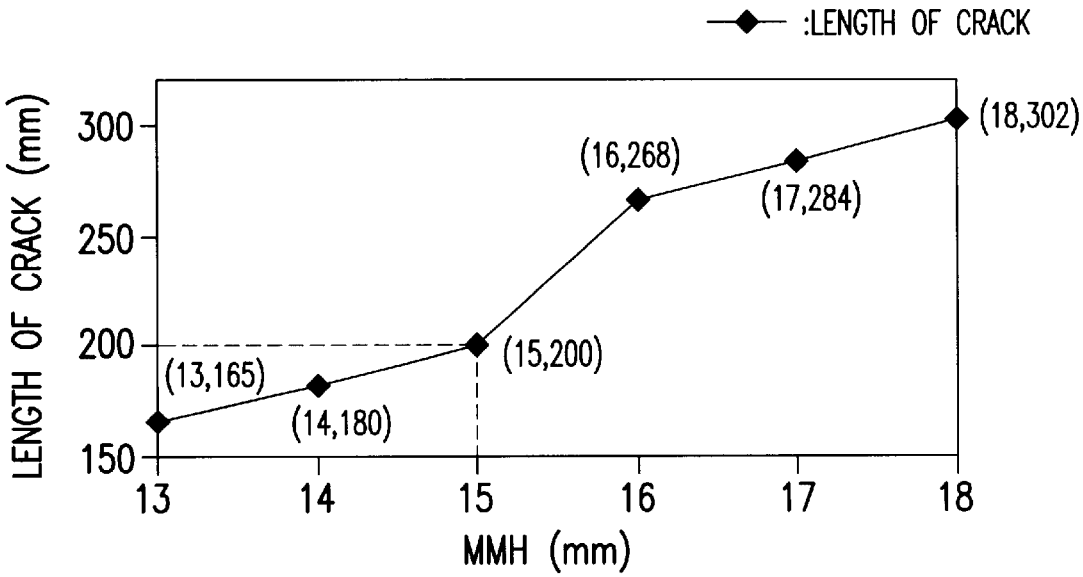
Figure 6B:
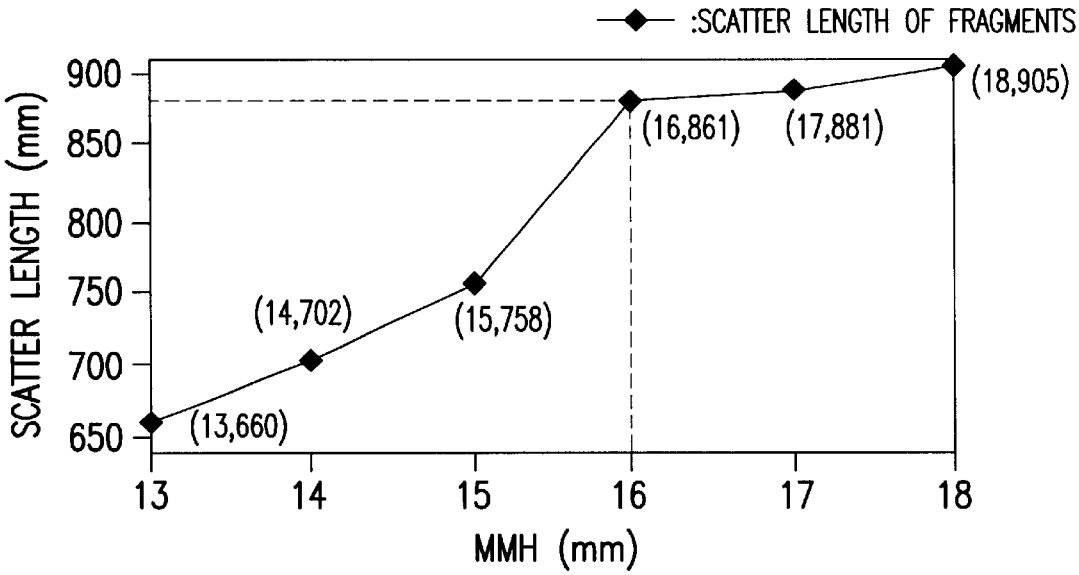

FIGS. 6*a* and 6*b* are graphs showing analysis results of the implosion-proof properties according to the change of a MMH of the panel according to the present invention, wherein FIG. 6*a* is a graph of the relationship between the MMH and the length of the crack and FIG. 6*b* is a graph of the relationship between the MMH and the scatter distance of the fragments.

In the structure of the panel according to the present invention, by changing the MMH such that the CFT is set to 15 mm, the implosion-proof properties are obtained as shown in FIGS. 6*a* and 6*b*.

That is, in case of the CFT of 15 mm in the panel of the flat-type CRT greater than the 29 inch standard, if the MMH is larger than 15 mm, an advance distance of the crack is rapidly increased, and thus the relationship of MMH≦CFT must be satisfied to effectively reduce the advance of the crack.

In other words, as shown in FIG. 6*a*, in a case which the CFT is 15 mm in length and only the MMH is changed, if the MMH is shorter than 15 mm, the change in the scatter distance of a crack and the length of the crack are smooth, but if the MMH is larger than the CFT, the scatter distance and the length of the crack are changed rapidly.

Here, the scatter distance of fragments refers to a distance of fragments of the panel 1 sputtered from a face part 1*a* when the panel 1 is fractured by shock. Based on one fragment, which is 0.025 g in weight, if the scatter distance of the fragment is more than 900 mm, it cannot satisfy standard conditions of a standard certifying organization.

From the analysis of the relationship between the CFT and the vacuum intensity and the analysis of the implosion-proof properties of the relationship between the CFT and the MMH, it is known that a contact area with the face part 1*a* becomes wider if the MMH is smaller than the CFT, and thereby the tension of a safety band reaches the face part 1*a* sufficiently and the advance of the crack due to external shock is effectively prevented.

Namely, a width of the face part 1*a* of the panel 1 located at a lower portion of the MML is expanded to the extent of a difference between the CFT and the MMH of FIG. 3 and the contact area is expanded if a circumference of the outer surface of the panel is multiplied to the expanded width.

Therefore, as described above, by making the MMH shorter than the CFT, even though a straight safety band 8*a* shown in FIG. 3 is used without using a bent implosion band 8, a flat-type CRT having sufficient implosion-proof properties can be manufactured.

Particularly, because the present invention has an excellent contact efficiency between the safety band 8*a* and the face part 1*a* of the panel, in a case which the safety band is made of a material having the same intensity as the conventional safety band, although the safety band, which is thinner than the conventional safety band, is used, stable implosion-proof properties can be secured.

Hereinafter, referring to FIG. 7, an analysis result of stress according to a change of the CFT/OAH value of the panel according to the present invention will be described.

Figure 7:
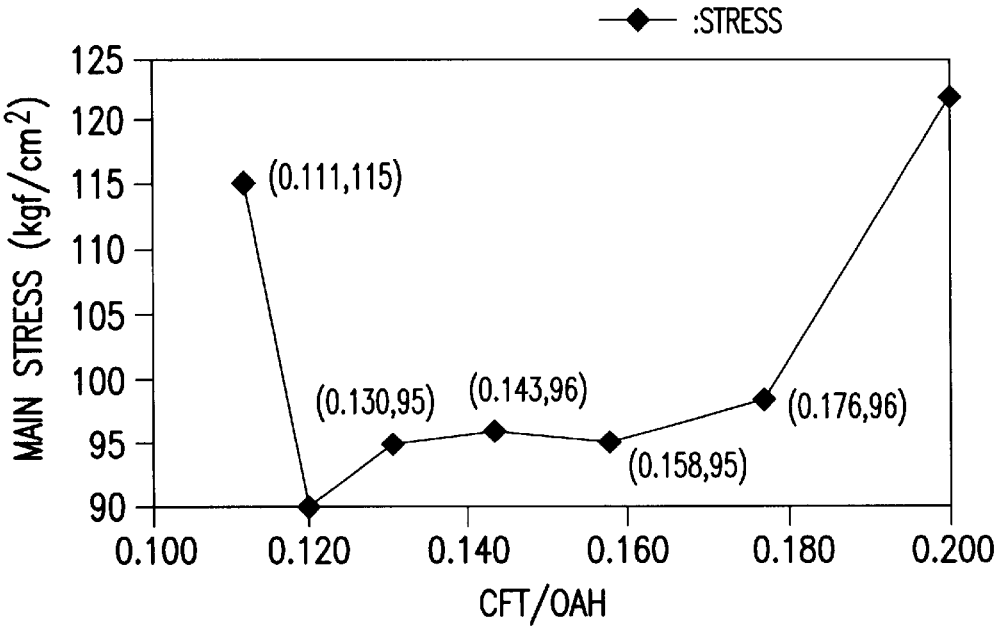
FIG. 7 is a graph showing an analysis result of stress according to the change of the CFT/OAH (Overall height) of the panel according to the present invention.

FIG. 7 is a graph of the analysis result of stress according to the change of the CFT/OAH value of the panel 1 of the present invention. If the OAH is changed such that the CFT of the panel 1 for the flat-type CRT is fixed, a magnitude of main stress and a generation position of the stress are changed.

That is, as shown in FIG. 7, in case that the CFT is 15 mm, the OAH is 135 mm and the CFT/OAH is 0.111, the main stress of 115 kgf is generated at the lower portion of the MML. In a case which the CFT is 15 mm, the OAH is 75 mm and the CFT/OAH is 0.200, the main stress of 122 kgf is generated at the conjunction part between the panel 1 and the funnel 2.

Therefore, in case of the CFT of 15 mm, if the CFT/OAH value is within a range of 0.12 through 0.15, the main stress is small and its generation position is the face part 1*a*, thereby securing stable vacuum intensity.

In FIG. 7, when the CFT/OAH value is 0.158, the main stress is 95 kgf, which is smaller than the CFT/OAH of 0.15. When the CFT/OAH value is 0.15, the main stress is applied to the panel, but when the CFT/OAH value is 0.158, the main stress is applied to the conjunction part of the panel and the funnel. The conjunction part is a relatively weak part in the vacuum condition of the CRT. If the main stress is applied to the conjunction part, the conjunction part may be damaged by the concentration of the stress. Thus, it is preferable that the CFT/OAH value is within the range of 0.12 to 0.15.

FIG. 7 shows an analysis result in a state which the CFT is set to 15 mm. However, if the CFT/OAH is within the range of 0.12 to 0.15 even though the CFT is larger than 15 mm, the stress is small and the stress is applied to the face part 1*a* , thereby securing stable vacuum intensity.

Namely, because a length of a skirt part 1*b* increases if the OAH is too large under the fixed CFT, the main stress is concentrated on the lower portion of the MML. If the OAH is too short, the main stress is concentrated on the conjunction part between the panel 1 and the funnel 2, and thus it is disadvantageous in obtaining stable vacuum intensity.

Furthermore, if the OAH is calculated when the relationship between the OAH and the CFT is $0.12 \leqq CFT/OAH \leqq 0.15$, $100\ mm \leqq OAH \leqq 125\ mm$ is obtained in case of the CFT of 15 mm, and $90\ mm \leqq OAH \leqq 133\ mm$ is obtained in case of the CFT of 14 to 16 mm.

As described above, in the present invention, even though the straight safety band 8*a* is used in the present invention, the contact area between the safety band 8*a* and the face part 1*a* of the panel is expanded, and the relationship between the MMH, the CFT and the OAH, which are design factors of the panel 1, is optimized to apply sufficient tension to the face part 1*a* of the panel 1, so that the panel 1 for the flat-type CRT can have stable vacuum intensity and implosion-proof properties.

Therefore, the improvement of the vacuum intensity and of the implosion-proof properties of the panel by the optimization of the relationship among the MMH, the CFT and the OAH is effective in improving reliability of the flat-type CRT.

That is, because the sufficient tension can be applied to the face part of the panel even though the straight safety band (which is easy in manufacturing) is used, there is no burden of additional expenses required for bending the safety band and stable vacuum intensity can be secured. Furthermore, the advance of the crack due to external shock can be restricted and the scattering of the fragments can be reduced effectively, so that the implosion-proof properties are considerably improved. Therefore, the present invention has various effects in aspects of productivity and reliability of the products.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A structure of panel in flat-type CRT (Cathode Ray Tube), which includes a face part having a flat outer surface and an inner surface of a fixed curvature, and a skirt part extending from an edge of the face part to a rear portion, wherein, when a height from a MML (Mold Match Line) which is an extension line of a match line between an upper external mold and a lower external mold to form the panel to an outer center of a face of the panel is designated as a MMH and a thickness of the center of the face surface of the panel is designated as a CFT, the relationship between the MMH and the CFT satisfies $MMH \leqq CFT$.

2. The structure as claimed in claim 1, wherein, when a height from an end of the skirt part of the panel to a front surface of the face part is designated as an OAH, the relationship between the OAH and the CFT satisfies $0.12 \leqq CFT/OAH \leqq 0.15$

3. A structure of panel in flat-type CRT (Cathode Ray Tube), which includes a face part having a flat outer surface and an inner surface of a fixed curvature, and a skirt part extending from an edge of the face part to a rear portion, wherein, when a height from a MML (Mold Match Line) which is an extension line of a match line between an upper external mold and a lower external mold to form the panel to an outer center of a face of the panel is designated as a MMH and a thickness of the center of the face surface of the panel is designated as a CFT, the relationship between the MMH and the CFT satisfies $MMH \leqq CFT$ and the CFT is larger than 15 mm.

4. The structure as claimed in claim 3, wherein, when a height from an end of the skirt part of the panel to a front surface of the face part is designated as an OAH, the relationship between the OAH and the CFT satisfies $0.12 \leqq CFT/OAH \leqq 0.15$.

5. The structure as claimed in claims 1 and 4, wherein the OAH satisfies $90 \leqq OAH \leqq 133$.

* * * * *